US005129535A

United States Patent [19]

Hradisky

[11] Patent Number: 5,129,535

[45] Date of Patent: Jul. 14, 1992

[54] TRASH CONTAINER SYSTEM AND COVER THEREOF

[75] Inventor: John L. Hradisky, Medina, Ohio

[73] Assignee: Rubbermaid Incorporated, Wooster, Ohio

[21] Appl. No.: 637,295

[22] Filed: Jan. 3, 1991

[51] Int. Cl.[5] ..... B65D 25/22

[52] U.S. Cl. ..... 220/23.4; 220/23.83; 220/335; 220/337; 220/367; 220/657; 220/659; 220/909; 206/505; 206/519

[58] Field of Search ..... 220/23.4, 23.6, 334, 220/335, 337, 367, 657, 659, 908, 909, 23.83; 206/505, 519

[56] References Cited

U.S. PATENT DOCUMENTS

| | | | |
|---|---|---|---|
| D. 280,459 | 9/1985 | McClelland | D34/8 |
| D. 281,111 | 10/1985 | McClelland | D34/8 |
| 2,316,674 | 4/1973 | Dow et al. | 220/334 X |
| 3,482,730 | 12/1969 | Podwalny | 220/31 |
| 3,749,274 | 7/1973 | Mele et al. | 220/908 X |
| 3,763,980 | 10/1973 | Vom Stein et al. | 220/23.4 X |
| 4,328,902 | 5/1982 | North | 220/23.4 |
| 4,886,239 | 12/1989 | Stimmel | 220/23.4 X |
| 4,889,254 | 12/1989 | Vola | 220/23.4 |
| 4,966,298 | 10/1990 | von Holdt | 220/23.4 |
| 4,979,618 | 12/1990 | Pellegrini Afri | 220/23.4 |
| 4,982,858 | 1/1991 | von Holdt | 220/23.4 X |
| 5,050,755 | 9/1991 | Strawder | 220/23.4 |

FOREIGN PATENT DOCUMENTS

| | | | |
|---|---|---|---|
| 1259068 | 1/1968 | Fed. Rep. of Germany | 220/908 |
| 1099180 | 8/1955 | France | 220/23.4 |
| 846602 | 8/1960 | United Kingdom | 220/23.4 |
| 2232341 | 12/1990 | United Kingdom | 220/908 |

OTHER PUBLICATIONS

Rubbermaid Incorporated, Wooster, Ohio 44691; 4 pages brochure; 1988.

Sterilite Corporation, P.O. Box 524, Main St., Townsend, Mass.; one page advertisement; date unknown.

Sterilite Corporation, P.O. Box 524, Main St., Townsend, Mass.; 4 pages advertising; 1989.

Tucker Housewares, Subsidiary of Kidde, Inc., 25 Tucker Drive, Leominster, Mass. 01453; 3 page brochure; date unknown.

Hefty; 2 page sell sheet; date unknown.

Valley Craft, Inc., 2001 S. Highway 61, Lake City, Minn. 55041; one page advertisement; date unknown.

Tucker Housewares, 25 Tucker Drive, Leominster, Mass. 01453; Tucker Recycling System; 6 page brochure; date unknown.

*Primary Examiner*—Stephen Marcus
*Assistant Examiner*—Stephen Cronin
*Attorney, Agent, or Firm*—Renner, Kenner, Greive, Bobak, Taylor & Weber

[57] ABSTRACT

A trash container (10) includes a base container portion (11) and a cover (12). The base container portion (11) includes a front wall (15), a rear wall (16) and two side walls (13, 14) all extending upwardly from a bottom surface (17) to an upper rim (19) defining an open top (18). The side wall (13) is provided with outboard ribs (24, 25) having inboard beads (26, 27) thereon. The other side wall (14) is provided with inboard ribs (30, 31) having outboard beads (32, 33) thereon. The beads (26, 27) engage the beads (32, 33) of a like container (10A) to attach the container (10) to the like container (10A).

The cover (12) has a peripheral rim made up of a front U-shaped ledge (40) and a rear U-shaped ledge (43). A generally horizontal opening (49) is formed within the rear U-shaped ledge (43) and a trash receiving ramp (50) is positioned below the opening (49). A hood (53) extends upwardly from the front U-shaped ledge (40) and defines a second opening (52) which extends partially above the opening (49). Trash placed on ramp (50) will thus pass through the opening (52) and into the base container portion (11).

27 Claims, 3 Drawing Sheets

TRASH CONTAINER SYSTEM AND COVER THEREOF

TECHNICAL FIELD

This invention relates to trash containers and a unique cover therefor. More specifically, this invention relates to a system whereby like trash containers can be coupled together to form a unit for the segregation of household refuse for recycle and like purposes.

BACKGROUND ART

Most every household and office utilizes trash receptacles to contain discarded refuse therein. Recently, based primarily on the desire to recycle certain types of refuse, manufacturers of trash containers have directed their attention to providing some type of means by which the trash can be segregated by type or size. Most simply, some manufacturers merely color code conventional trash containers thereby urging or prompting the user to place certain types of trash in certain colored containers.

Other manufacturers have designed specially configured containers or bins to promote the recycle effort. Such containers, while too often multi-colored, are usually designed to stack on each other to present a vertical array of multiple containers. While such designs certainly do save floor space, the tipping stability of some of the designs is quite suspect. Moreover, the access openings to the stacked containers is not only limited, but also is generally incapable of being closed with a cover.

If the household container, whether intended for recycle or not, is provided with a cover, usually it is of the type which can be swung, either manually or by a foot pedal, to either a fully open or fully closed position. Such thus requires some activity on the part of the user to expose the inside of the container to receive the refuse.

Some modern containers are provided with lids known as a swing top cover which normally totally close the container but which, when rotated by hand or under the influence of the weight of the refuse, swing out of the way to permit the refuse to drop into the container. While these covers are acceptable alternatives to those which are merely rotated on hinges from either a fully open to a fully closed position, they are more costly to manufacture and assemble than most refuse container covers and are susceptible to problems in that they will tend to fail to fully close as the container becomes full of refuse, that is, the refuse impedes the swinging return to the fully closed position.

Thus, there is not only a need for a special system of containers for segregating refuse, but also there is a continuing need for conveniently usable covers for household waste receptacles.

DISCLOSURE OF THE INVENTION

It is thus a primary object of the present invention to provide a trash container system by which any number of otherwise relatively conventionally configured trash containers can be attached together and in a modular fashion formed into an integral system.

It is another object of the present invention to provide a trash container system, as above, which is stable such that the containers will not tip or fall if bumped by the user.

It is still another object of the present invention to provide a trash container system, as above, which includes a plurality of containers configured to conveniently receive and efficiently hold conventional plastic bags or paper bags typically used to receive trash.

It is a further object of the present invention to provide a trash container system, as above, in which the individual containers are readily nestable within each other without lodging.

It is another object of the present invention to provide a trash container system, as above, which can be positioned close to a wall thereby saving floor space.

It is a related object of the present invention to provide a cover for a trash container which can readily be positioned on the container to be swingable from open and closed positions, and yet be easily removable from the container.

It is a further object of the present invention to provide a cover, as above, which when in a closed position still provides partial access to the container which it is closing.

It is an additional object of the present invention to provide a cover, as above., with an integral means to readily transport trash through the area of partial access.

It is yet another object of the present invention to provide a cover, as above, in which visual access, through the partial access area, to the sometimes visually offensive trash, is prevented.

These and other objects of the present invention, as well as the advantages thereof over existing prior art forms, which will become apparent from the description to follow, are accomplished by the means hereinafter described and claimed.

In general, a container is designed to be attached to a like container and includes a front wall, a rear wall, and two side walls. All of these walls extend upwardly from a bottom surface to an upper rim which defines an open top for the container. A first connector assembly is provided on one of the side walls and a second connector assembly is provided on the other side wall. The first connector assembly of the container is adapted to engage the second connector assembly of the like container and the second connector assembly of the container is adapted to engage the first connector assembly of the like container to form the modular system of the invention.

A cover is provided to close the open top of the container. The cover has a peripheral rim with a generally horizontal opening therein. A trash receiving ramp is positioned below the opening. A hood extends upwardly from the cover rim and defines a second opening extending partially above the horizontal opening. Trash placed on the ramp will pass through the second opening and into the container.

A preferred exemplary trash container system, as well as a cover therefor, incorporating the concepts of the present invention is shown by way of example in the accompanying drawings without attempting to show all the various forms and modifications in which the invention might be embodied, the invention being measured by the appended claims and not by the details of the specification.

PREFERRED EMBODIMENT FOR CARRYING OUT THE INVENTION

Figure 1:
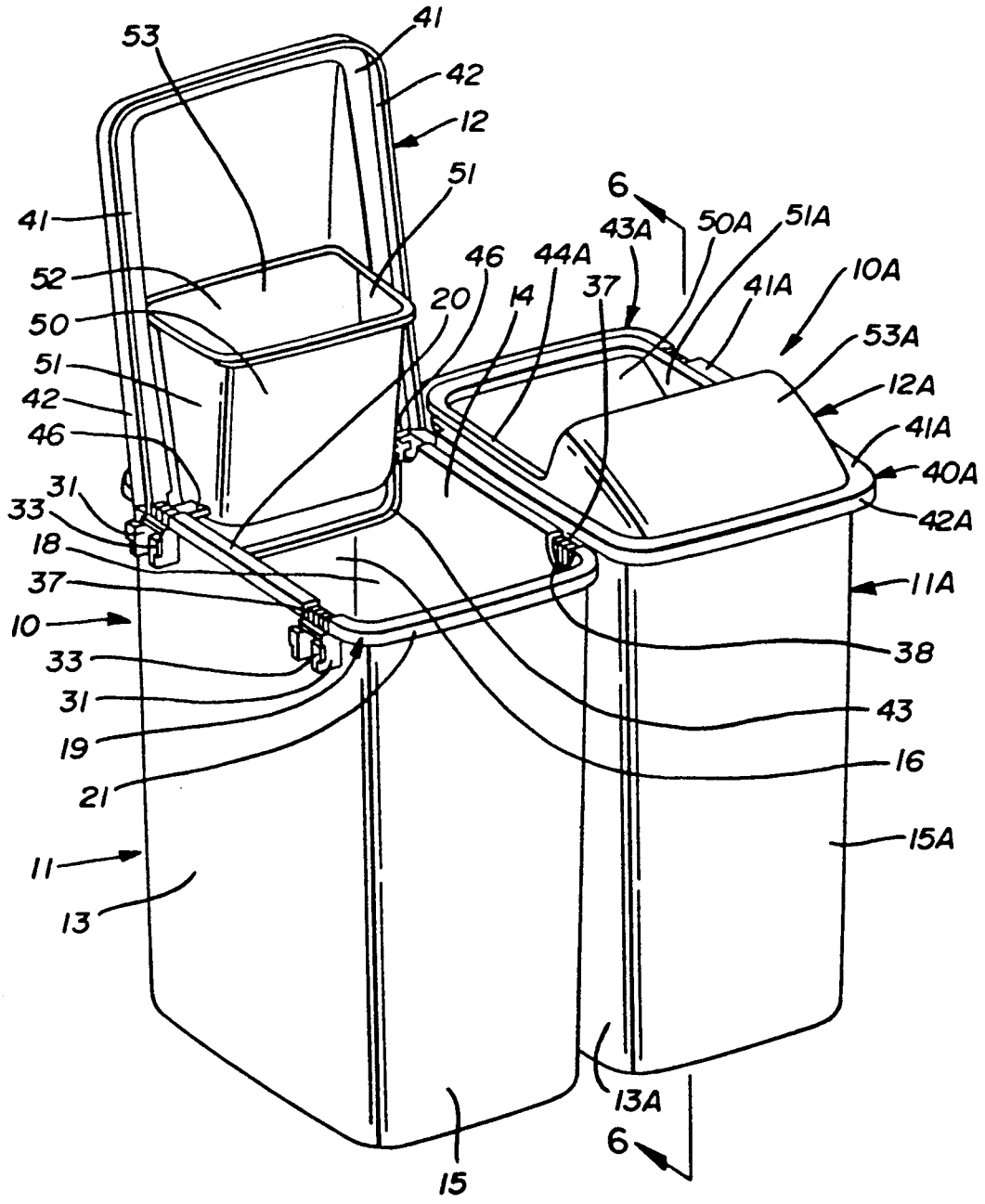
FIG. 1 is a somewhat schematic perspective view of two like containers forming the system of the present invention, one container being shown as having a cover according to the present invention in a swung open position, and the other container having its cover in the closed position.

A container according to the concept of the present invention is indicated generally by the numeral 10 in FIG. 1 and is shown as being attached to a like container indicated generally by the numeral 10A. Containers 10 and 10A are thus identical and where like parts of container 10A are shown in the drawings and discussed with reference to container 10, those like parts will be identified for container 10A with like reference numerals followed by the suffix A.

Figure 6:
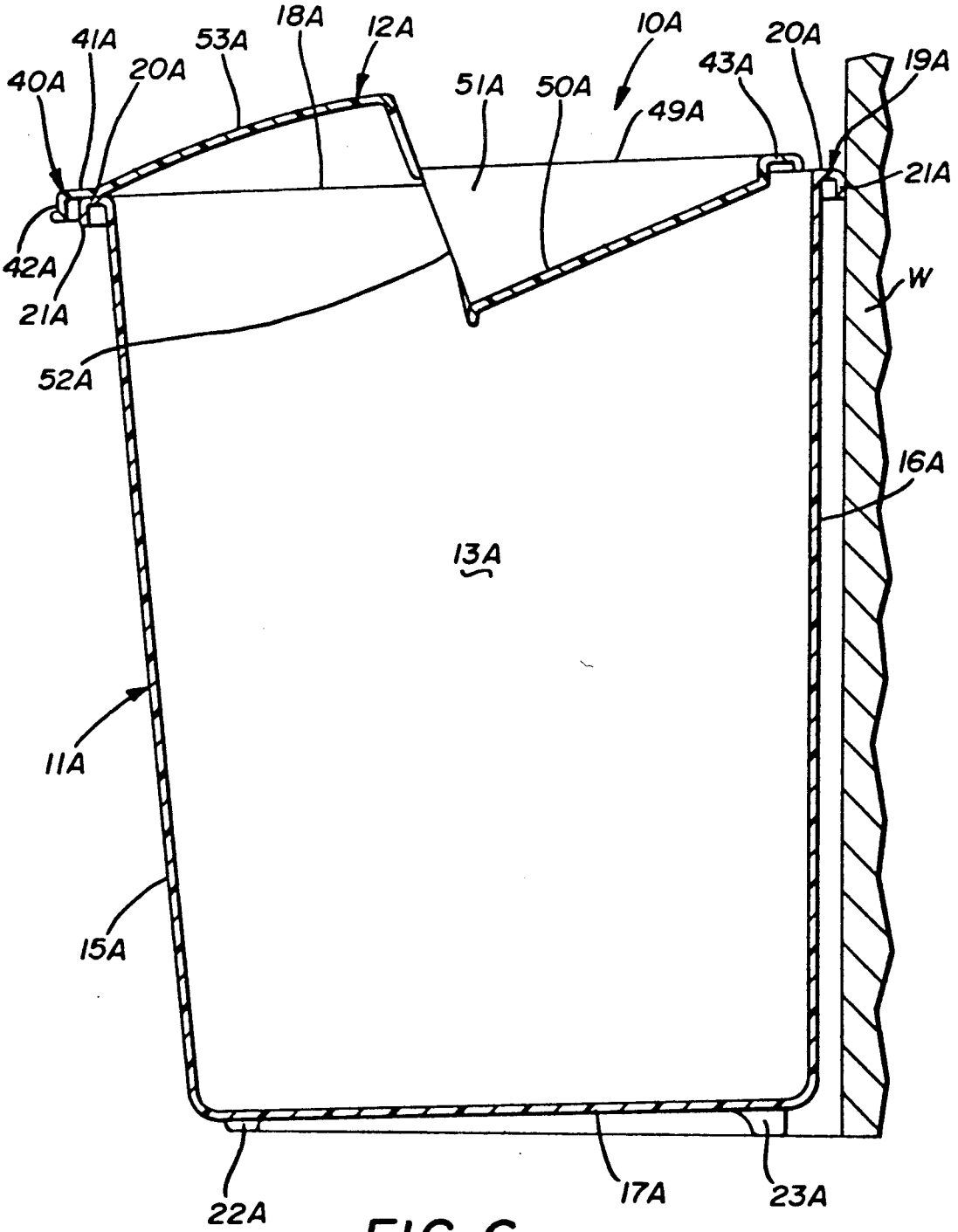
FIG. 6 is a vertical sectional view taken substantially along line 6—6 of FIG. 1 and showing the like container positioned adjacent to a wall.

Container 10, which is preferably molded out of any suitable plastic material as would be well known to one of ordinary skill in the art, includes a base container portion, generally indicated by the numeral 11, and a cover generally indicated by the numeral 12. As best shown in FIGS. 1 and 6, base container portion 12 includes side walls 13, 14, a front wall 15 and a rear wall 16, all extending generally vertically upwardly from a bottom surface 17A (not shown for container 10) to form an open top 18. Open top 18 is defined by an upper rim generally indicated by the numeral 19 and formed at the top of walls 13, 14, 15 and 16. Rim 19 includes a generally horizontal shelf 20 and a downturned generally vertical lip 21.

As shown in FIG. 6, base container portion 11 is provided with a foot structure which includes a front foot portion and a rear foot portion, 22A and 23A, respectively (not shown for container 10) which extend downwardly from bottom surface 17A. The foot structure could take the form of a continuous rim extending downwardly from bottom surface 17A or could be in the form of a plurality of individual feet. In either event, for reasons to be hereinafter described, it is preferable that rear foot portion 23A be larger or longer than front foot portion 22A such that bottom surface 17A slopes slightly downwardly from rear to front, as shown. Base container portion 11 is preferably sized to receive a conventional plastic refuse bag liner or even a conventionally sized paper bag, such as a grocery bag, often found in the home. When such a bag is positioned in base container portion 11, the slope of bottom surface 17A will urge the inserted bag forwardly toward front wall 15 thereby eliminating an undesirable space, at the top, between the bag and front wall 15, where refuse could become inadvertently lodged or displaced thereby creating a potential untidy condition within base container portion 11.

Most conventional containers have all of their walls drafted or tapered slightly outwardly and upwardly from bottom to top, not only for ease of molding but also to provide a means by which a container may be nested within a like container for economical shipment or display. However, as shown in FIG. 6, base container portion 11 is not so configured. Rather, rear wall 16 is essentially vertical and front wall 15 is drafted outwardly at an angle of approximately 6°, at least twice the draft angle for conventional containers. As such, container 10 can still be nested within a like container, such as container 10A, and can be positioned closer to a wall W (FIG. 6), being spaced therefrom only by the width of shelf 20. Moreover, such configuration cooperates with the slope of bottom surface 17A to urge the lining bag forwardly, as previously described.

Figure 2:
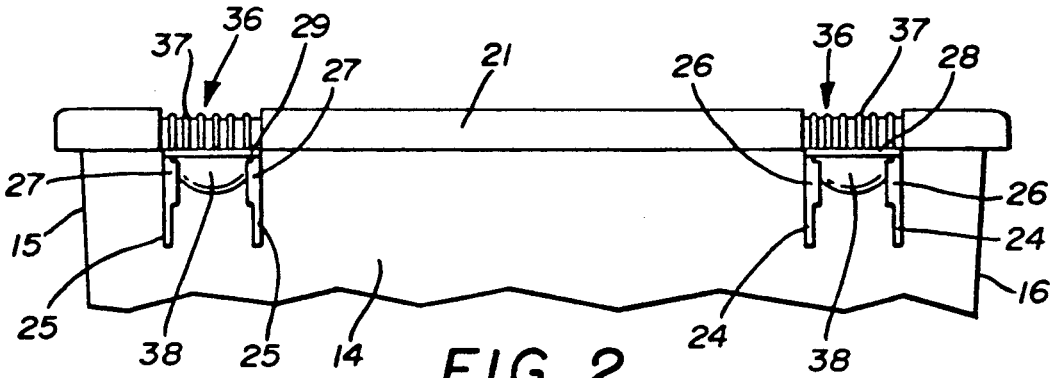
FIG. 2 is a partial elevational view of one side of a container which, with a like container, forms the system of the present invention.

The manner in which container 10 may be attached or connected to like container 10A is best shown in FIGS. 2-5. With reference to FIG. 2, side wall 14 of each container is provided with a connector assembly which includes a pair of spaced outboard ribs 24 extending downwardly from rim 19 near rear wall 16 and a similar pair of spaced outboard ribs 25 extending downwardly from rim 19 near front wall 15. Each rib 24 is provided with an inboard locking bead 26 positioned on the outer end thereof (FIG. 4), which beads extend laterally toward each other (FIG. 2). As such, beads 26 face each other and effectively reduce the distance between ribs 24 at that location. Each rib 25 is likewise provided with an inboard locking bead 27 positioned on the outer end thereof and extending laterally toward each other. As such, beads 27 effectively reduce the distance between ribs 25 at that location. A generally horizontal spacing ledge 28, generally parallel to and below rim shelf 20, extends between the top of ribs 24 and a similar spacing ledge 29 extends between the top of ribs 25.

Figure 3:
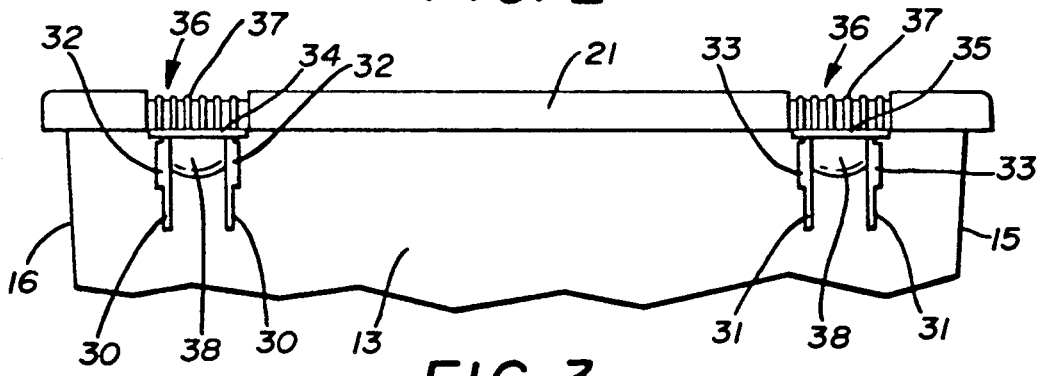
FIG. 3 is a partial elevational view of the side of the container opposite to that shown in FIG. 2.

With reference to FIG. 3, the other side wall 13 of each container is provided with a connector assembly which includes a pair of spaced inboard ribs 30 extending downwardly from rim 19 near rear wall 16 and a similar pair of spaced inboard ribs 31 extending downwardly from rim 19 near front wall 15. As will hereinafter be described in more detail, the space between outboard ribs 24 and the spacing between outboard ribs 25 is designed to be greater than the external distance between ribs 30 and the external distance between ribs 31 so that ribs 30 of a container 10 will fit within and between ribs 24 of a like container, such as container 10A, and so that ribs 31 of a container 10 will fit within and between ribs 25 of a like container such as container 10A.

Each rib 30 is provided with an outboard locking bead 32 positioned on the outer end thereof (FIG. 5), which beads extend laterally away from each other (FIG. 3). As such, beads 32 effectively increase the distance between the outer dimension of ribs 30 at that location. Each rib 31 is likewise provided with an outboard locking bead 33 positioned on the outer end thereof and extending laterally away from each other. As such, beads 33 effectively increase the distance between the outer dimension of ribs 31 at that location. A generally horizontal spacing ledge 34, generally parallel to and below rim shelf 20, extends between the top of ribs 30 and a similar spacing ledge 35 extends between the top of ribs 31.

As shown in FIGS. 2-5, the internal or lateral space between beads 26 and the internal or lateral space between beads 27 is designed to be slightly less than the laterally outer dimension between beads 32 and the laterally outer dimension between beads 33 thereby creating a slight lateral interference between beads 26 of a container 10 with beads 32 of a like container, such as container 10A, and a slight lateral interference between beads 27 of a container 10 and beads 33 of a like container, such as container 10A. As such, when it is desired to create a system of containers, a container 10 can be positioned with its side wall 14 adjacent to the side wall 13A of a like container 10A, and manually the containers can be moved toward each other and snapped together by overcoming the slight interference of the respective beads such that beads 26 of container 10 engage, or are engaged by, beads 32 of the like container and beads 27 of container 10 engage, or are engaged by, beads 33 of the like container. Of course, at this time ribs 30 of the like container are received between ribs 24 of container 10 and ribs 31 of the like container are received between ribs 25 of container 10. As such, a modular system of as many containers as desired by the user can readily be built by the user.

In order to visually highlight and to tactilely assist the user in effecting the connection, shelf 20 of rim 19 is interrupted or recessed, as at 36, at the four locations of ribs 24, 25, 30 and 31. At each recess 36, shelf 20 is provided with a ribbed surface 37 which, as shown in FIG. 1, extends downwardly into an arcuate cutout 38 on the inside of side walls 13 and 14. Such enables the user to readily visually locate ribs 24, 25, 30 and 31 and also provides a gripping area for the thumb and fingers to snap two containers together. Of course, when it is desired to disassemble the containers, they may be readily pulled apart as easily as they were connected. Moreover, as previously described, despite the fact that rear wall 16 is generally vertical, like containers can easily nest within container 10, and when so nested, the bottoms of ribs 24, 25, 30 and 31 are adapted to engage shelf 20 of the container positioned therebelow to avoid a wedging of one container in another.

Figure 4:
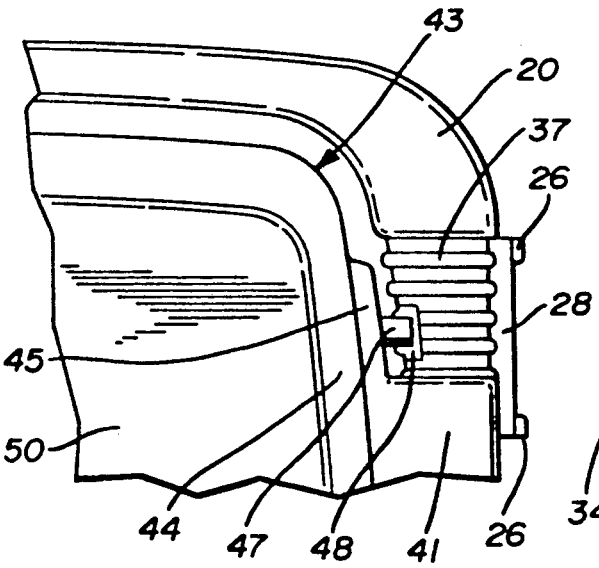
FIG. 4 is a partial plan view showing a rear corner of the container including the side shown in FIG. 2 with the cover in a closed position.
Figure 5:
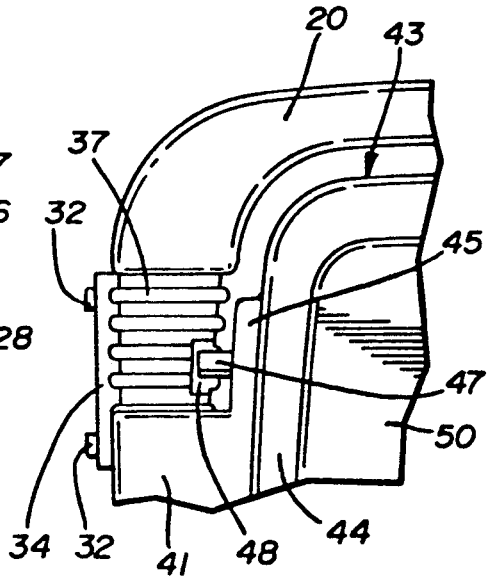
FIG. 5 is a partial plan view showing a rear corner of the container including the side shown in FIG. 3 with the cover in a closed position.

While container 10, just described, can be utilized without a cover or with any conventional cover, the cover 12 shown is preferred for use with the system. Cover 12 is formed with a U-shaped (in plan view) front peripheral rim, generally indicated by the numeral 40, which includes a generally horizontal ledge 41 and a downturned skirt 42. As shown in FIG. 6, when positioned on base container portion 11, ledge 41 rests on shelf 20 and skirt 42 surrounds lip 21. When positioned on base container portion 11, rim 40 extends peripherally around front surface 15 and along a portion of side walls 13 and 14 thereof, terminating at the location just above the beginning of rear recesses 36 in rim 19 as best seen in FIGS. 4 and 5.

The remainder of the cover rim at the rear of cover 12 is defined by a U-shaped (in plan view) rim or peripheral ledge 43 positioned adjacent to rear wall 16. The branches 44 of ledge 43 parallel and are integrally formed with ledge 41 as it extends along side walls 13 and 14 of base container portion 11. As shown in FIGS. 4 and 5, pin support brackets 45, which are given structural strength by webs 46 under cover 12 (FIG. 1), extend rearwardly from ledge 41 and laterally outwardly from branches 44. Each bracket 45 carries a pin 47, and pins 47 are received in sockets 48 formed in recess 36 of shelf 20 of base container portion 11. As such, cover 12 is placed on base container portion 11 by locating pins 47 in sockets 48. Cover 12 may then be rotated, in a hinge-like fashion, to open container 10, as shown in FIG. 1, with pins 47 rotating in sockets 48. When closed, and with container 10 attached to like container 10A, as previously described, there is room for the adjacent skirts 42, 42A of the containers because of the clearance provided by the adjacent spacing ledges 28, 34 and 29, 35. Thus, covers 12, 12A can be freely opened and closed without interference from an adjacent cover.

As perhaps most readily observed in FIG. 6, an opening 49A (not seen for cover 12) is formed in the horizontal plane defined by U-shaped ledge 43, opening 49A thereby being within the confines of the U-shape of ledge 43. A trash receiving ramp 50 is positioned directly below opening 49A and extends downwardly from the back of ledge 43 at an angle of approximately 45°. Ramp 50 terminates generally medially of cover 12 and when cover 12 is positioned on base container portion 11, the bottom of ramp 50 is well below rim 19 and open top 18 of base container portion 11. Generally vertical side walls 51 extend upward from the sides of ramp 50 to branches 44 of ledge 43 and define, with ramp 50, a trash receiving chute. Trash which is positioned on ramp 5 will fall along ramp 50 within the confines of side walls 51 and pass through an opening 52 and into base container portion 11. The upper extent of opening 52, which lies in a plane approximately 90° to ramp 50, is vertically higher than opening 49A and is defined by an arcuate hood 53 which extends from opening 52 down to ledge 41. Because opening 52 faces the end of the cover having pins 47, and thus faces wall W in the preferred positioning of container 10, the user will not be subjected to viewing any unsightly trash in view of the presence of hood 53.

It should thus be appreciated that cover 12 may be utilized in any of three manners to gain access to the contents of base container portion 11. First, pins 47 may be disengaged from sockets 48 to gain total access to base container portion 11 as may be convenient, for example, when inserting a trash collecting bag or removing a full bag. Second, with pins 47 in sockets 48, cover 12 can be swung to the open position as shown with respect to container 10 in FIG. 1, as may be convenient, for example, when placing larger waste items in base container portion 11. Finally, with cover 12 closed, as shown with respect to container 10A in FIG. 1, smaller trash items can merely be deposited on ramp 50 to be received, as previously described, in base container portion 11.

It should thus be evident that the cover and trash container system described herein accomplishes the objects of the invention and otherwise substantially improves the art.

I claim:

1. A container, adapted to be attached to a like container, comprising a front wall, rear wall, and two side walls extending upwardly from a bottom surface to an upper rim defining an open top; first connector means on one said side wall, said first connector means on one said side wall, said first connector means including spaced bead members and spaced rib members extending generally downwardly from near said upper rim and carrying said bead members of said first connector means; and second connector means on the other said side wall, said second connector means including spaced bead members and spaced rib members extending generally downwardly from near said upper rim and carrying said bead members of said second connector means; said bead members of said first connector means being adapted to engage the bead members of the second connector means of the like container and said bead members of said second connector means being adapted to engage the bead members of the first connector means of the like container.

2. A container according to claim 1 wherein said rear wall is generally vertical and said front wall tapers outwardly from said bottom surface to said upper rim so that the container can be nested within the like container, said spaced rib members of said first connector means and said spaced rib members of said second connector means engaging the upper rim of the like container when the container is nested within the like container.

3. A container according to claim 1 wherein said rib members of said first connector means are spaced laterally apart more than the lateral spacing of said rib members of said second connector means so that said rib members of said second connector means are received between the rib members of the first connector means of the like container and said rib members of said first connector means receive the rib members of the second connector means of the like container therebetween.

4. A container according to claim 3 wherein said bead members of said first connector means extend from said rib members of said first connector means laterally toward each other and said bead members of said second connector means extend from said rib members of said second connector means laterally away from each other so that said bead members of said first connector means interfere with the bead members of the second connector means of the like container and said bead members of said second connector means interfere with the bead members of the first connector means of the like container as the container is being attached to the like container, the interference being overcome to attach the container to the like container.

5. A container according to claim 4, there being two first connector means, one near said front wall and one near said rear wall; and two second connector means, one near said front wall and one near said rear wall.

6. A container according to claim 4 further comprising a ledge member above said first connector means and a ledge member above said second connector means, said ledge members of said first connector means and said second connector means cooperating with the ledge members of the second connector means and the first connector means, respectively, of the like container to space the container from the like container when the containers are attached.

7. A container according to claim 6 further comprising a cover for closing said open top, said cover having a downturned skirt, said downturned skirt of said cover and the downturned skirt of the cover of the like container being received within the space between the containers formed by said ledge member of the container and the ledge member of the like container.

8. A container according to claim 4 further comprising means to cover said open top.

9. A container according to claim 8 wherein said means to cover includes a peripheral rim, a generally horizontal opening within said rim, a ramp positioned below said opening, and a hood extending upwardly from said rim and defining a second opening extending partially vertically above said horizontal opening such that items passed through said horizontal opening and positioned on said ramp will pass through said second opening and into the container.

10. A container according to claim 9 wherein said ramp slopes downwardly from said peripheral rim to a position below said open top.

11. A container according to claim 10 wherein the plane of said ramp is approximately 90° of the plane of said second opening.

12. A container according to claim 9 wherein said second opening faces said rear wall.

13. A container according to claim 9 further comprising socket means positioned in said upper rim near said rear wall, and pin means carried by said peripheral rim of said means to cover, said socket means adapted to engage said pin means so that said means to cover may be rotated on said pin means with respect to said socket means.

14. A container according to claim 13 wherein said second opening is closer to said front wall than said pin means.

15. A container according to claim 9 further comprising a ledge member above said first connector means, a ledge member above said second connector means, said ledge members of said first connector means and said second connector means cooperating with the ledge members of the second connector means and the first connector means, respectively, of the like container to space the containers from the like containers when the containers are attached, and said peripheral rim of said means to cover having a downturned skirt, said downturned skirt of said means to cover and the downturned skirt of the means to cover of the like container being received within the space between the containers formed by said ledge member of the container and the ledge member of the like container.

16. A container, adapted to be attached to a like container, comprising a front wall, rear wall, and two side walls extending upwardly from a bottom surface to an upper rim defining an open top; first connector means on one said side wall; second connector means on the other said side wall; said first connector means being adapted to engage the second connector means of the like container and said second connector means being adapted to engage the first connector means of the like container; said upper rim having an interrupted area above said first connector means and having an interrupted area above said second connector means; and a ribbed surface formed on said interrupted areas of said upper rim to identify the location of said first and second connector means.

17. A container, adapted to be attached to a like container, comprising a front wall, rear wall, and two side walls extending upwardly from a bottom surface to an upper rim defining an open top; first connector means on one said side wall; second connector means on the other said side wall; said first connector means being adapted to engage the second connector means of the like container and said second connector means being adapted to engage the first connector means of the like container; and a foot member including a rear foot portion on said bottom surface near said rear wall, and a front foot portion on said bottom surface near said front wall, said rear foot portion being longer than said front foot portion so that said bottom surface slopes downwardly from said rear wall to said front wall.

18. A container according to claim 17 wherein said rear wall is generally vertical and said front wall tapers outwardly from said bottom surface to said upper rim.

19. Apparatus adapted to cover the upper open top of a container comprising a peripheral rim, a generally horizontal opening within said rim, a ramp positioned below said opening, and a hood extending upwardly from said rim and defining a second opening extending partially vertically above said horizontal opening such that items passed through said horizontal opening and positioned on said ramp will pass through said second opening and into the container.

20. Apparatus according to claim 19 wherein said ramp slopes downwardly from said peripheral rim to a position below the upper open top of the container.

21. Apparatus according to claim 20 wherein the plane of said ramp is approximately 90° of the plane of said second opening.

22. Apparatus according to claim 19 wherein the upper open top of the container is defined by a rim at the top of a front wall, two side walls and a rear wall and said peripheral rim includes a first U-shaped ledge positionable on the container rim along the front wall and a portion of the side walls, said hood extending upwardly from said U-shaped ledge.

23. Apparatus according to claim 22 wherein said peripheral rim includes a second U-shaped ledge adjacent to the rear wall of the container and extending along a portion of the side walls to join said first -shaped ledge, said generally horizontal opening being within said second U-shaped ledge.

24. Apparatus according to claim 23 wherein said second opening faces the rear wall of the container.

25. Apparatus according to claim 23 wherein sockets are formed in the rim of the container above the side walls near the rear wall of the container and further comprising pin members extending outwardly from said second U-shaped ledge, said pin members being adapted to be received in the sockets.

26. Apparatus according to claim 25 wherein said pin members are between said second opening and the rear wall of the container.

27. Apparatus according to claim 19 wherein the upper open top of the container is defined by a rim at the top of a front wall, two side walls, and a rear wall, the container having means to connect a side wall to the side wall of a like container and means to space the container from the like container, further comprising a skirt extending downwardly from said peripheral rim, said lip being received in the space between the container and the like container.

* * * * *

UNITED STATES PATENT AND TRADEMARK OFFICE

CERTIFICATE OF CORRECTION

PATENT NO. : 5,129,535

DATED : July 14, 1992

INVENTOR(S) : John L. Hradisky

It is certified that error appears in the above-identified patent and that said Letters Patent is hereby corrected as shown below:

On the title page: [54] "THEREOF" should read --THEREFOR--.

Column 1, line 3, "THEREOF" should read --THEREFOR--.

Column 6, line 22, "ramp 5" should read --ramp 50--.

Column 6, lines 57-58 (claim 1), following the word "means" in line 57, delete the words "on one said side wall, said first connector means".

Column 7, line 58 (claim 8), "4" should read --1--.

Column 9, line 24 (claim 23), "first -shaped" should read --first U-shaped--.

Signed and Sealed this

First Day of March, 1994

*Attest:*

*Attesting Officer*

BRUCE LEHMAN

*Commissioner of Patents and Trademarks*